US005471221A

United States Patent [19]

Nalbandian et al.

[11] Patent Number: 5,471,221

[45] Date of Patent: Nov. 28, 1995

[54] DUAL-FREQUENCY MICROSTRIP ANTENNA WITH INSERTED STRIPS

[75] Inventors: Vahakn Nalbandian, Ocean, N.J.; Choon S. Lee, Dallas, Tex.

[73] Assignee: The United States of America as represented by the Secretary of the Army, Washington, D.C.

[21] Appl. No.: 272,911

[22] Filed: Jun. 27, 1994

[51] Int. Cl.[6] ..... H01Q 1/38

[52] U.S. Cl. ..... 343/700 MS; 333/134; 333/219

[58] Field of Search ..... 343/700 MS; 333/1, 333/134, 24 R, 219, 245, 246; H01Q 1/38

[56] References Cited

U.S. PATENT DOCUMENTS

| | | | |
|---|---|---|---|
| 3,575,674 | 4/1971 | Howe | 333/10 |
| 4,575,725 | 3/1986 | Tresselt | 343/700 MS |
| 4,685,210 | 8/1987 | King et al. | 29/830 |
| 4,761,654 | 8/1988 | Zaghloul | 343/700 MS |
| 4,907,006 | 3/1990 | Nishikawa et al. | 343/700 MS |
| 4,914,445 | 4/1990 | Shoemaker | 343/700 MS |
| 4,933,680 | 6/1990 | Shapiro et al. | 343/700 MS |
| 5,045,819 | 9/1991 | Balanis et al. | 333/1 |
| 5,155,493 | 10/1992 | Thursby et al. | 343/700 MS |
| 5,319,378 | 6/1994 | Nalbandian et al. | 343/700 MS |

FOREIGN PATENT DOCUMENTS

| | | | |
|---|---|---|---|
| 2097196 | 10/1982 | United Kingdom | 343/700 MS |

*Primary Examiner*—Donald T. Hajec
*Assistant Examiner*—Steven Wigmore
*Attorney, Agent, or Firm*—Michael Zelenka; William H. Anderson

[57] ABSTRACT

A dual-frequency microstrip antenna has three strips of bare low-dielectric material alternating with two strips of copper-clad (one side) high-dielectric material bonded close together on a copper plate having a feed inserted therethrough. A copper-claded layer (one side) low-dielectric material is placed over the five strips and bonded simultaneously. The inner strips separate the region of high-dielectric constant from the region of low-dielectric constant. The microstrip antenna is considered to be a lossy resonating cavity enclosed by a perfect electric conductor and by a perfect magnetic conductor.

9 Claims, 4 Drawing Sheets

DUAL-FREQUENCY MICROSTRIP ANTENNA WITH INSERTED STRIPS

GOVERNMENT INTEREST

The invention described herein may be manufactured, used, and licensed by or for the Government of the United States of America without the payment to us of any royalty thereon.

FIELD OF THE INVENTION

The invention relates in general to the field of microwave and millimeter wave microstrip antennas, and in particular, to a dual-frequency microstrip antenna having inserted strips therein.

BACKGROUND OF THE INVENTION

Microstrip antennas have been widely used because of their advantages over conventional antennas. These advantages include lightweight construction, low cost, and low profile as compared to conventional, bulkier antennas. However, the bandwidth of most microstrip antennas is too narrow for many practical applications. There have been numerous attempts to increase the bandwidth. However, when the operating frequencies are widely separated, even those improved microstrip antennas may not provide sufficient bandwidth. In many applications, such as in the Global Positioning Systems (GPSs), only a few distinct frequency bands are needed rather than a continuous spectrum of operating frequency. Dual-band microstrip antennas have been suggested to meet such requirements. Heretofore, these antennas often have had two independent cavities stacked together or have had vertical conducting connections from the ground plane to the upper patch. However, both of these methods have been difficult to fabricate.

SUMMARY OF THE INVENTION

Accordingly, it is an object of the invention to provide an improved dual-frequency microstrip antenna.

It is a further object of the invention to provide a dual-frequency microstrip antenna which is within a single structure and does not require the vertical connections featured in certain designs of the prior art.

It is a further object of the invention to provide a dual-frequency microstrip antenna having wide frequency separations.

These and other objects of the invention are provided by a dual-frequency microstrip antenna which comprises three strips of low-dielectric material and two strips of copper cladded (one side) high-dielectric material bonded closely together on a copper plate in an alternating fashion such that two of the strips of the low dielectric material are on the outer edges of the antenna and the strips of high dieletric material, which sandwich the third strip of low dielectric material, are, in turn, sandwiched by the outer strips of low dielectric material. A fourth, larger copper cladded (one side) layer of low-dielectric material is then bonded over these five strips.

The resonant frequencies of the microstrip antenna according to the invention can be varied over a wide range of frequencies. The input impedances are matched at both resonant frequencies more easily than the available dual-band microstrip antennas. The fabrication process for the microstrip antenna according to the invention is relatively simple.

The microstrip antenna according to the invention has widespread applications, such as in multiband communication systems, aircraft and communication stations.

BRIEF DESCRIPTION OF THE DRAWINGS

These and other features and details of the invention will become apparent in light of the ensuing detailed disclosure, and in particularly in light of the drawings wherein.

FIGS. *5a* and *5b* show examples of the electric fields of the two lowest-order modes in the cavity according to the invention.

Figure 1:
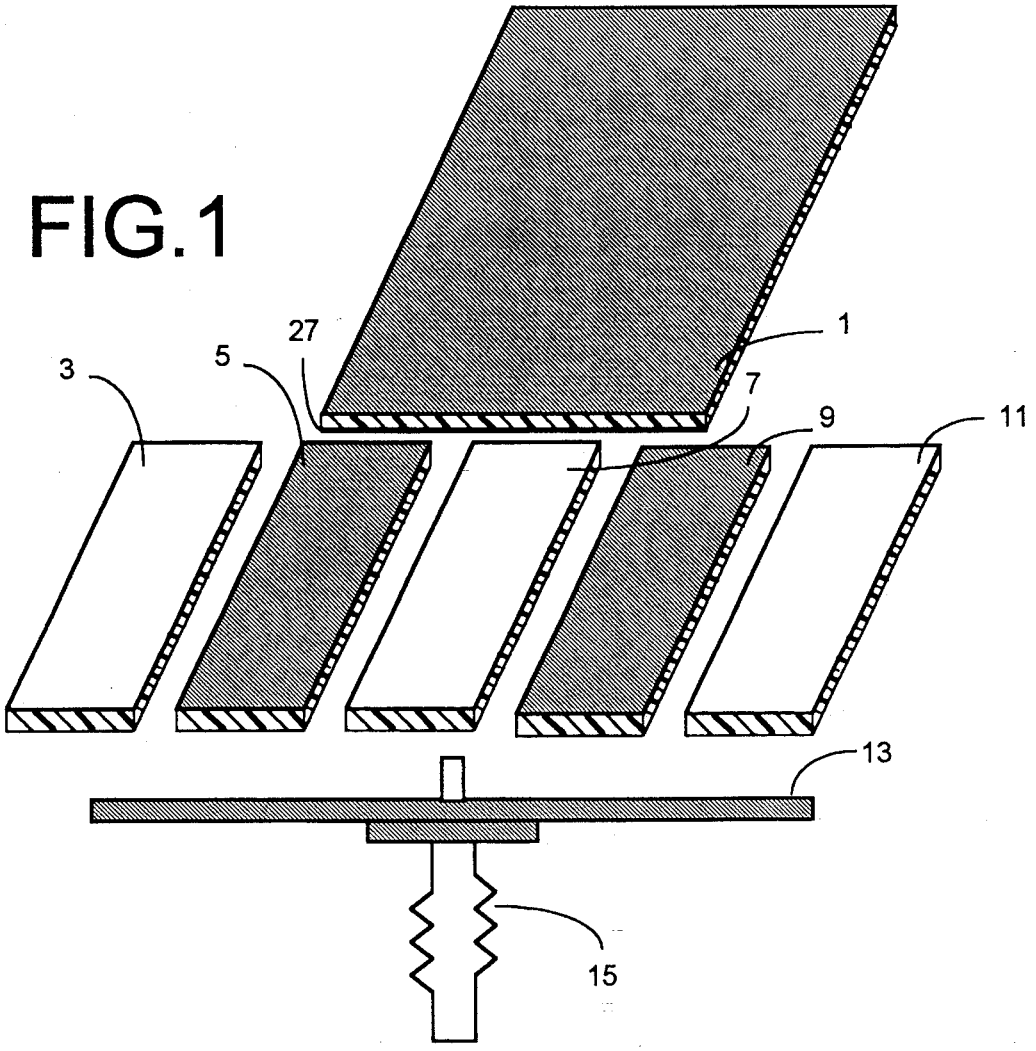
FIG. 1 shows a front view of a microstrip antenna according to a preferred embodiment of the invention.
Figure 2:
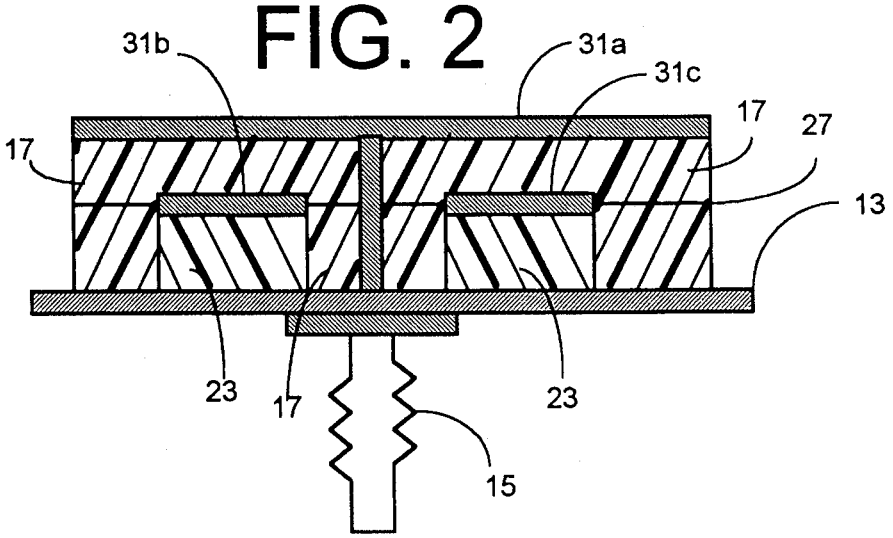
FIG. 2 shows a side view of the invention.

In both FIGS. 1 and 2, the height of the dielectric strips and layers is exaggerated for purposes of illustration.

DESCRIPTION OF THE PREFERRED EMBODIMENTS

Referring to FIGS. 1 and 2, three strips of low-dielectric material 3, 7, and 11 and two strips of copper cladded (one side) high-dielectric material 5 and 9 are bonded close together on a copper plate 13 in an alternating fashion such that two of the strips of the low dielectric material are on the outer edges of the antenna and the strips of high dieletric material, which sandwich the third strip of low dielectric material, are, in turn, sandwiched by the outer strips of low dielectric material (see FIG. 1). In other words, the inner strips separate a region of high-dielectric constant 23 (FIG. 2) from a region of low-dielectric constant 17 (FIG. 2). Then, a copper-claded (one side) layer of low-dielectric material 1 is bonded over the five strips 3, 5, 7, 9, and 11 (FIG. 1).

Figure 3:
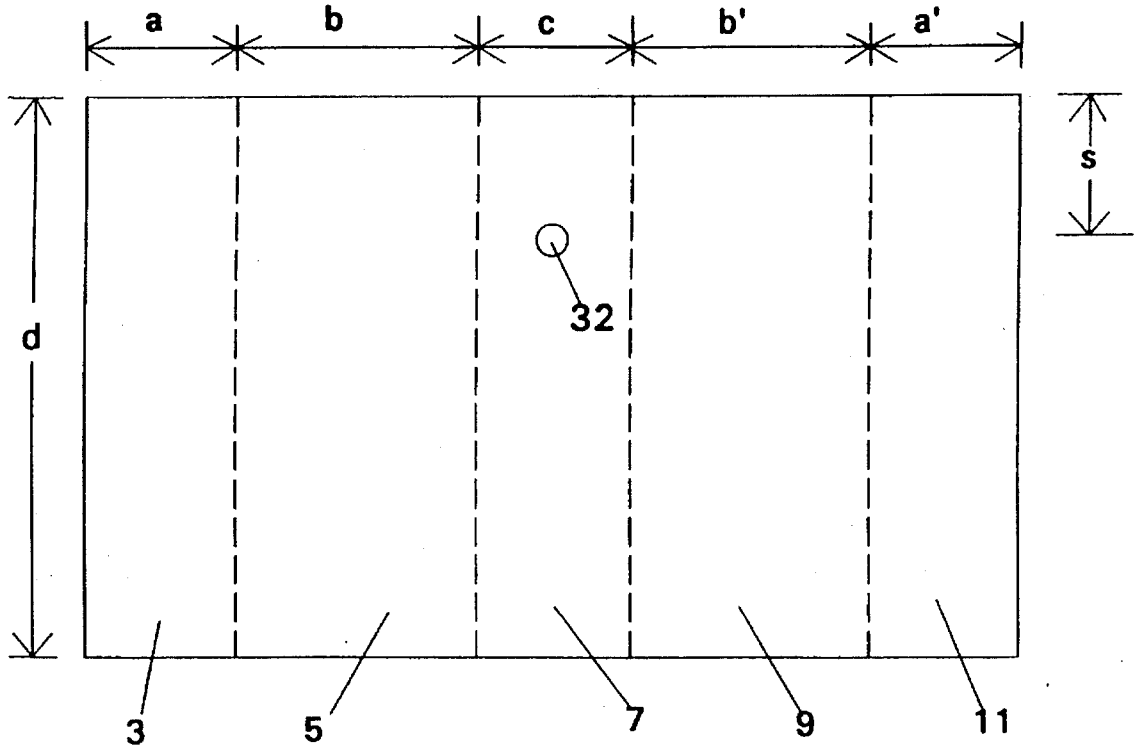
FIG. 3 shows a top view of the invention.

The inner strips are symmetrically placed to ensure symmetric H-plane radiation patterns and to ensure symmetric radiation patterns along the plane of the radiation edges. The feed 15 (32 in FIG. 3) is located such that the radiating edges are perpendicular to the inner strips. FIG. 3 illustrates a top view of the microstrip antenna according to the invention. The dotted lines indicate the boundaries between each of the five strips, which would not normally be visible from a top view due to obstruction by the layer of copper cladded low dielectric material 1 of FIGS. 1 and 2.

In an experiment to show the effectiveness of the present invention, a layer of 20 mil thick DUROID (Rogers Corp. DUROID™ 5880) was used as the microstrip material. The relative dielectric constant for the low-dielectric material 3, 7, and 11 was 2.2 and 6.2 for the high-dielectric material 5 and 9. A SMA probe 15 with 50-ohm impedance was used for the feed. Very thin, 1.5 mil cuclad bonding film (27 of FIG. 2) by ARLON, with a dielectric constant of 2.3, was used for thermal bonding between this multilayer structure and to a 62-mil thick copper ground plane (13 of FIG. 2). The dimensions of the strips 3, 5, 7, 9 and 11 of FIG. 3 were chosen such that the distances a and a' are 0.7 cm, the distances b and b' are 2.5 cm, the distance c is 0.6 cm, the distance d is 2.5 cm, and the distance s is 0.7 cm. As will be recognized by one of ordinary skill in the art, the fabrication process for the microstrip antenna of this experiment was relatively simple, even though microwave and millimeter wave integrated circuitry (MMIC) could be used for mass production.

This arrangement results in two types of field excitation. The field variation along the radiation edges determines the type of mode excitation while the sinusoidal field variation occurs along the inner strips. The fields of lower resonance are highly excited in the high-dielectric region 23 (FIG. 2) and are exponentially decaying in the low-dielectric region 17 (FIG. 2). In contrast, the fields of the higher-order mode are strong in the low-dielectric region.

Figure 5A:
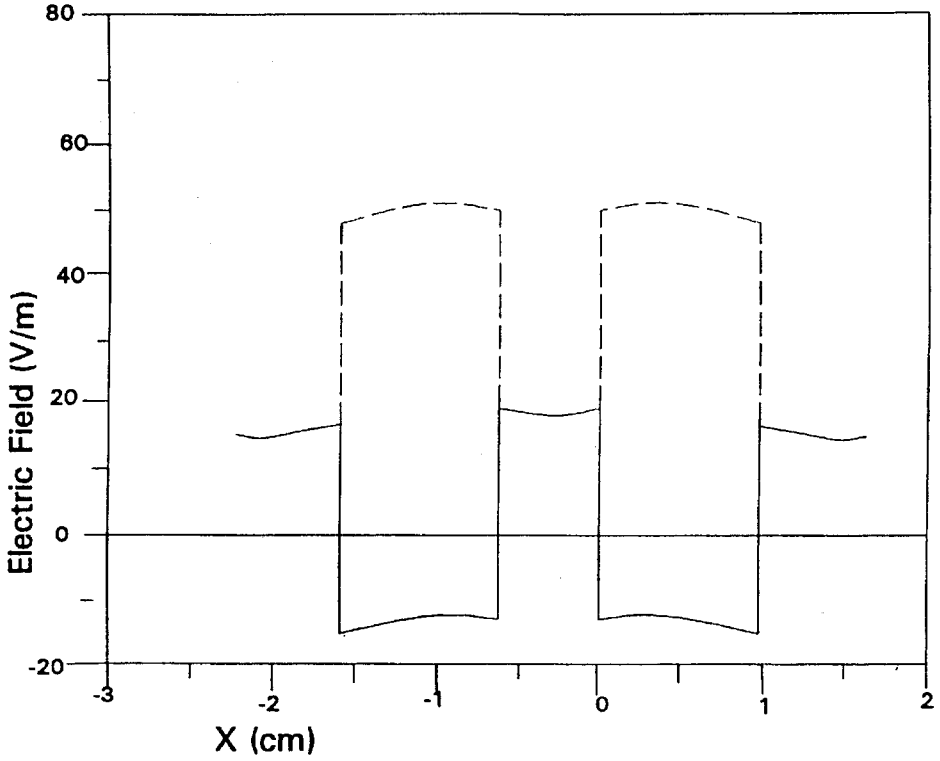
Figure 5B:
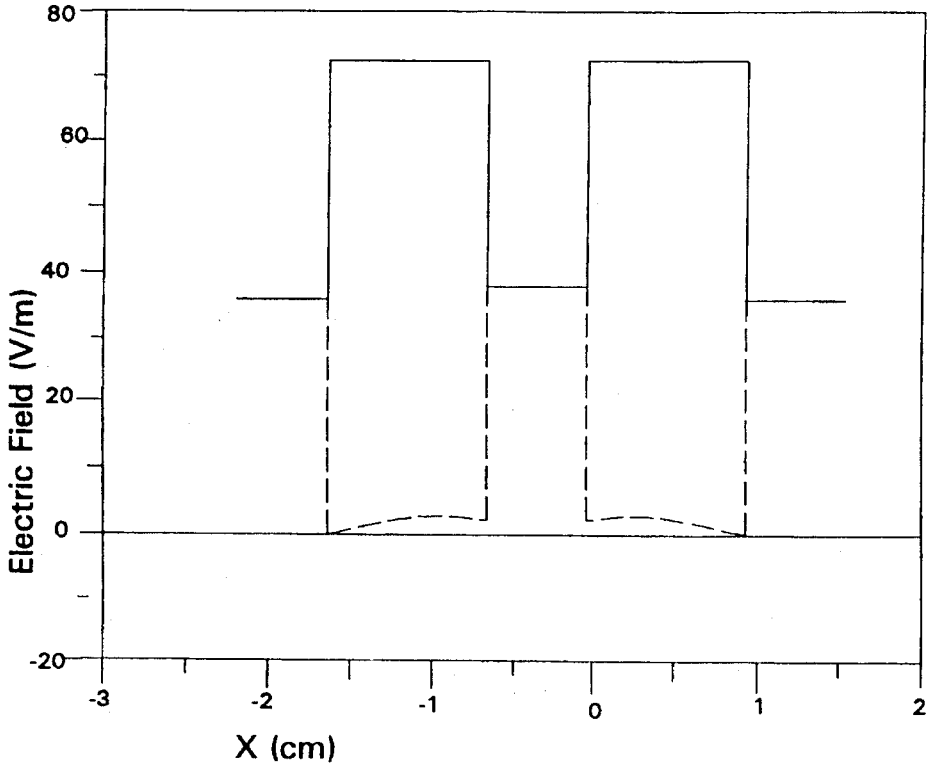

Since the microstrip antenna may be considered a lossy resonating cavity enclosed by a perfect electric conductor for the metallic surfaces 31*a*, 31*b*, 31*c* and by a perfect magnetic conductor for the open-ended strip edges and since the layers are very thin, only a single dominant mode exists everywhere in the cavity except near the edges of the inner strips. This is true even though the inhomogeneously filled cavity results in two types of mode excitation. As the inner strips move within the cavity, the resonant frequencies do not change much, but the fields vary considerably near the feed 15 (FIGS. 1 and 2 and 32 in FIG. 3). The field strength of the lower resonance varies significantly while that of the higher resonance basically does not change with a shift of the inner strips. FIGS. 5*a* and 5*b* show the electric fields of the two lowest-order modes in the cavity. The fields of only the dominant mode in each region are shown. The fields of lower resonance (FIG. 5*a*) are large in the high-dielectric region and decay exponentially in the low-dielectric region. On the other hand, the fields of the higher-order mode (FIG. 5*b*) are negligible in the high-dielectric region. Since the high-dielectric material occupies a smaller volume than the low-dielectric material, the lowest-order mode results in less radiation efficiency. Thus, the rapidly decaying evanescent modes are confined within a small region near the edges of the inner strips.

These results make the impedance-matching extremely easy because the input impedance can be matched almost independently at the two resonant frequencies. Therefore, the input impedances may be matched at both resonant frequencies by simply shifting the feed 32 and the high-dielectric strips within the cavity. Further, the resonant frequencies may be adjusted by proper selection of the two different types of material and the relative size of the high-dielectric region 23 (FIG. 2 and represented by 5 and 9 of FIG. 1). Furthermore, it is possible to change the resonant frequencies with a variation of the layer thickness or width of the high-dielectric material.

Figure 4:
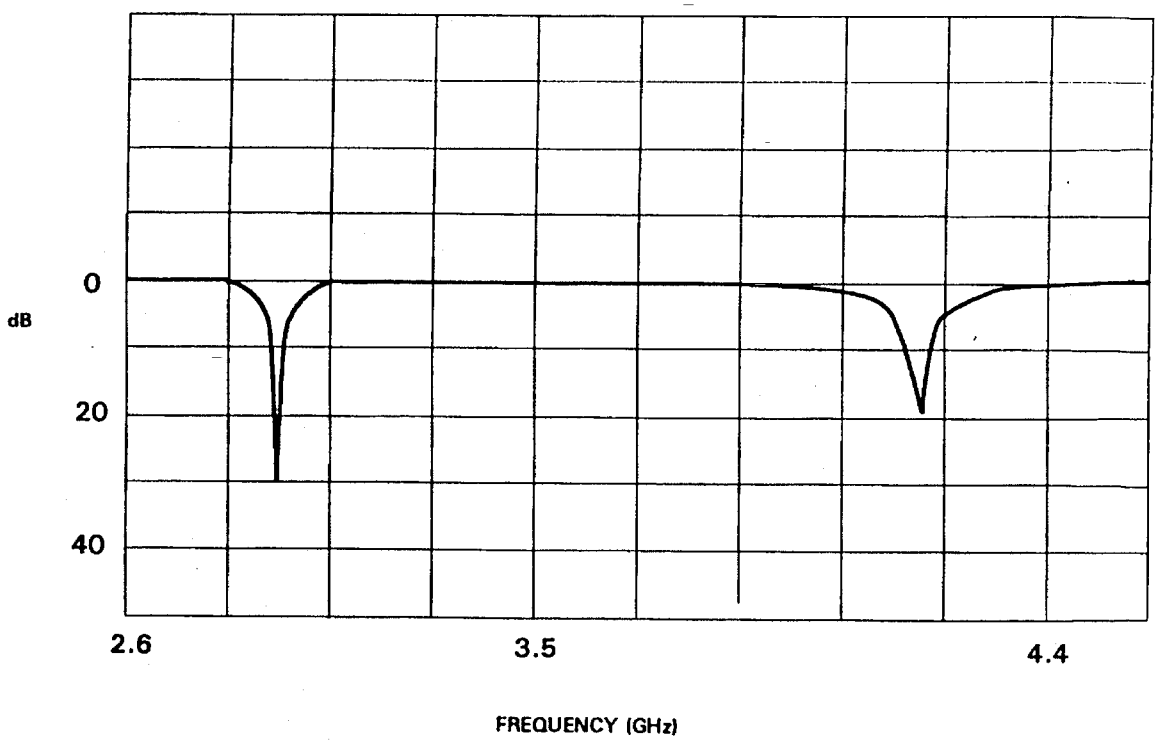
FIG. 4 shows an example of a plot of the return loss versus frequency for a microstrip antenna according to the invention.

A plot of the return loss versus frequency of the experimental device is shown in FIG. 4. The double resonances are clearly observed. The measured resonant frequencies were 2.85 and 4.00 GHz compared to the theoretical resonant frequencies of 2.63 and 4.04 GHz. The slight discrepancies may be due to the uncertainty of the dielectric constants and error in the fabrication process. The narrow bandwidth of the lowest resonance indicates the reduced radiation efficiency because of the concentrated fields in the high-dielectric region. The radiation patterns at both frequencies, although not shown, were good.

For purposes of theoretical analysis, it is assumed that the upper layer has the same thickness as the lower layer and a mode-matching technique is used because of its relatively simple approach and physical insight. The layer thickness is assumed to be small compared to the wavelength so that device may be validly assumed to be a lossy resonant cavity enclosed by a perfect electric conductor at the metallic surfaces 31*a*, 31*b*, and 31*c* of FIG. 2 and by a perfect magnetic conductor at the open-ended strip edges. See Y. T. Lo et al, "Theory and Experiments on Microstrip Antennas," "*IEEE Transactions on Microwave Theory and Technology,*" Vol. AP-27, pp. 137–145 (1979). This article is incorporated herein for informational purposes. Furthermore, the formulation is greatly simplified when constant interface fields are assumed at the inner-strip edges. With these assumptions, the interface fields at one end of the strip are simply related to those at the other end. The explicit expressions defining these interfaces are given in the Appendix of an article written by the inventors herein and entitled, "Dual-Frequency Microstrip Antenna with Inhomogeneously Filled Dielectric Substrate," *Microwave and Optical Technology Letters,* Sep. 5, 1993, wherein a transcendental equation for non-vanishing fields at the interfaces is solved numerically for the resonant frequencies. Another article written by the inventors herein which will provide other background information concerning the present invention is entitled, "Dual-Frequency Microstrip Antenna with Inserted Strips," *IEEE, Antenna & Propagation Society Digest,* Jul. 1, 1993. These articles are also incorporated herein by reference. Briefly though and considering only the two lowest-order modes, the solution of the equation mentioned above is reduced to finding the normal modes in half of the cavity. As is shown in this proof, only the dominant TM fields exist in the cavity except near the edges of the inner strips and the rapidly decaying evanescent fields are confined within a small region near the strip edges.

Although the present invention has been described with reference to only one embodiment, those skilled in the art will readily recognize that other embodiments consistent with the teachings of the present invention are possible. Accordingly, the inventors do not wish to limit their invention by the above detailed description, but only by the appended claims.

What is claimed is:

1. A dual-frequency microstrip antenna comprising:

a conductive ground plate means having a feed inserted therethrough;

at least three strips of a first dielectric material bonded to the conductive ground plate means in a spatially-separated manner, the first dielectric material having a first dielectric constant;

at least two strips of a second dielectric material bonded to the conductive ground plate means at locations within spaces separating the three strips of the first dielectric material, the strips of a second dielectric material having a conductive cladding which is separated from the conductive ground plate means and the feed, and the strips of a second dielectric material having a second dielectric constant which is higher than the first dielectric constant; and a dielectric covering over an upper surface of the three strips of the first dielectric material and over an upper surface of the two strips of the second dielectric material, the dielectric covering having a radiating conductive cladding which electrically contacts the feed;

wherein the three strips of the first dielectric material form low dielectric regions and the two strips of the second dielectric material form high dielectric regions, and wherein the high and low dielectric regions establish low and high resonance regions, respectively, wherein fields of lower resonance are excited in the high dielectric regions and exponentially decay in the low dielectric regions and fields of higher resonance are excited in the low dielectric regions.

2. The microstrip antenna according to claim 1, wherein the conductive ground plate means comprises a copper ground plate.

3. The microstrip antenna according to claim 1, wherein each of the three strips of the first dielectric material comprises a bare material and wherein each of the two strips of the second dielectric material comprises copper-clad material.

4. The microstrip antenna according to claim 3, wherein the bare material comprises 20-mil thick material having a dielectric constant on the order of 2.2 and wherein the copper-clad material comprises 20-mil thick material having a dielectric constant on the order of 6.2.

5. The microstrip antenna according to claim 1, wherein the dielectric covering comprises a copper-clad material.

6. The microstrip antenna according to claim 1, further comprising a bonding film for thermally bonding the three strips of the first dielectric material and the two strips of the second dielectric material to the conductive ground plate means and to the dielectric covering.

7. The microstrip antenna according to claim 6, wherein the bonding film comprises 1.5 mil of copper clad bonding film with a dielectric constant on the order of 2.3.

8. The microstrip antenna according to claim 1, wherein said feed is disposed in a geometric center area of said dielectric covering, the strips of dielectric material are symmetrically placed relative to said feed to ensure symmetric H-plane radiation and to ensure symmetric radiation patterns along a plane of radiation edges.

9. The microstrip antenna according to claim 8, said feed is positioned in the antenna such that the radiating edges are perpendicular to the strips of the second dielectric material, but not contacting the conductive cladding of the strips of the second dielectric material.

* * * * *